US006795998B1

(12) United States Patent
Kammerer et al.

(10) Patent No.: US 6,795,998 B1
(45) Date of Patent: Sep. 28, 2004

(54) SWAB WITH PULL-TRUDED TIP

(75) Inventors: K. Scott Kammerer, Atlanta, GA (US); Edward J. Forrest, Jr., Marietta, GA (US)

(73) Assignee: Illinois Tool Works, Inc., Glenview, IL (US)

( * ) Notice: Subject to any disclaimer, the term of this patent is extended or adjusted under 35 U.S.C. 154(b) by 424 days.

(21) Appl. No.: 09/621,722

(22) Filed: Jul. 24, 2000

(51) Int. Cl.[7] ..... A47L 25/00; A46B 3/00

(52) U.S. Cl. ..... 15/209.1; 15/143.1; 15/159.1; 300/21

(58) Field of Search ..... 604/1; 15/209.1, 15/210.1, 104.05, 104.16, 144.1, 159.1, 160, 143.1; 300/21; 264/243

(56) References Cited

U.S. PATENT DOCUMENTS

RE16,869 E 2/1928 Goldman ..... 132/75.3
1,903,664 A * 4/1933 Yutts ..... 15/226
3,712,296 A * 1/1973 Gradone ..... 600/572
5,001,803 A * 3/1991 Discko, Jr. ..... 15/167.1
5,084,005 A * 1/1992 Kachigian ..... 604/1
5,214,821 A * 6/1993 Burrow et al. ..... 15/210.1
5,937,473 A * 8/1999 Lisowski ..... 15/236.08
6,007,655 A * 12/1999 Gorthala et al. ..... 156/166
6,187,104 B1 * 2/2001 Bozarjian ..... 134/6

* cited by examiner

*Primary Examiner*—Terrence R. Till
*Assistant Examiner*—Laura C Cole
(74) *Attorney, Agent, or Firm*—Mark W. Croll, Esq.; Donald J. Breh, Esq.; Welsh & Katz, Ltd.

(57) ABSTRACT

A swab for cleaning electronic and electro-mechanical components includes a handle and a pull-truded fiber cleaning head. The handle is elongated and has a cleaning head end and a grasping end. The cleaning head end defines a securing region for securing the cleaning head to the handle. The cleaning head is formed from a plurality of fibers that are pulled through a die to compress the fibers into a substantially rigid, elongated cleaning head. The swab includes a tether to secure the swab and prevent inadvertent misplacement.

11 Claims, 1 Drawing Sheet

SWAB WITH PULL-TRUDED TIP

FIELD OF THE INVENTION

This invention pertains to a swab for cleaning. More particularly, the invention pertains to a swab having a tip or cleaning head portion that is formed from a pull-truded fibrous material and a method for making such swabs.

BACKGROUND OF THE INVENTION

Swabs are used in all manners of cleaning. For example, everyone will recognize common cotton tipped swabs that are used for person hygiene and care. Because of the compact and effective nature of these swabs, they have been adopted for use in numerous areas of technology and manufacture. One such area is the manufacture of electrical components and more specifically connectors for use in the telecommunications industry.

One particular type of connector used in the telecommunications industry is for use in fiber optic cables. In splicing or connecting fiber optic cable sections to one another, a connector is used. A typical connector includes a male portion and a female portion. During assembly of these cable sections, it is not unusual for pieces of debris and/or ambient soils, such as pieces of fiber or fiber coating debris to be left within the ends of the connectors. It is also not unusual for light oils, such as fingerprint and other natural skin oils and synthetic oils to be found on the ends of the connectors. As will be recognized by those skilled in the art, this debris and the oils can significantly degrade or prevent the transmission capabilities of the cables across the connectors.

Numerous types of cleaning implements have been used, with some degrees of success, to clean these particularly susceptible areas. It has, however, been observed that cleaning implements formed from non-particulate removing materials may not be acceptable for use in these connectors. Specifically, it has been found that particulates can become lodged in and around the connectors, thus adversely effecting the quality of the telecommunications signal.

In addition, it has been observed that these connectors can vary from one type to another. For example, the connector female end can be formed as having a flat inner end surface, a concave surface or a convex surface. To this end, it has been found that regardless of the type of cleaning implement used, debris that settles into and around corners and oils that are present in these areas of the connector devices cannot be adequately removed.

Moreover, many of the currently used cleaning devices use foam-based cleaning heads. The foam portions of these devices can adversely affect the fiber optic conductors or may scratch the microscopic conductors. In addition, there are no currently known cleaning implements that can be used to clean the inside diameter of fiber optic connector ferrules.

Accordingly, there exists a need for a swab-type cleaning device that can be used for cleaning a variety of delicate, electrical and electro-mechanical devices, and particularly fiber optic connectors. Desirably, such a device is configured so that it can be used to clean narrow or small spaces, without degrading when cleaning slots and the like in devices such as fiber optic connectors, as well as junction regions of walls and/or surfaces. Most desirably, such a cleaning device removes contaminants, including particulate and light oils without leaving any of its own debris, such as particulate or matter.

SUMMARY OF THE INVENTION

A swab for cleaning for example, fiber optic connectors and electrical and electro-mechanical components includes an elongated handle having a cleaning head end and a grasping end, and a cleaning head secured to the handle. The handle defines a longitudinal axis and defines a securing region.

The cleaning head or tip is formed from a plurality of fibers that are pulled through a die to compress the fibers into the substantially rigid, elongated cleaning head. The cleaning head is secured to the handle at the cleaning head end. The handle and cleaning tip define a longitudinal axis.

In a preferred embodiment, the cleaning tip is formed from polyester fibers. Preferably, the handle is a hollow tubular member that defines a central bore and the cleaning tip is formed having a shape and a dimension for inserting into the handle bore. In this arrangement, the cleaning tip is secured to the handle by friction-fit. Alternately, the cleaning tip is secured to the handle by heat, by an adhesive, by ultrasonic welding or the like.

The swab can include a tether secured to the handle grasping end. The tether can be secured to the handle by insertion into the handle bore. Alternately, the tether can be attached to the handle by a grip portion mounted externally over the grasping end of the handle.

These and other features and advantages of the present invention will be apparent from the following detailed description, in conjunction with the accompanying drawings, and the appended claims.

DETAILED DESCRIPTION OF THE PREFERRED EMBODIMENTS

Figure 1:
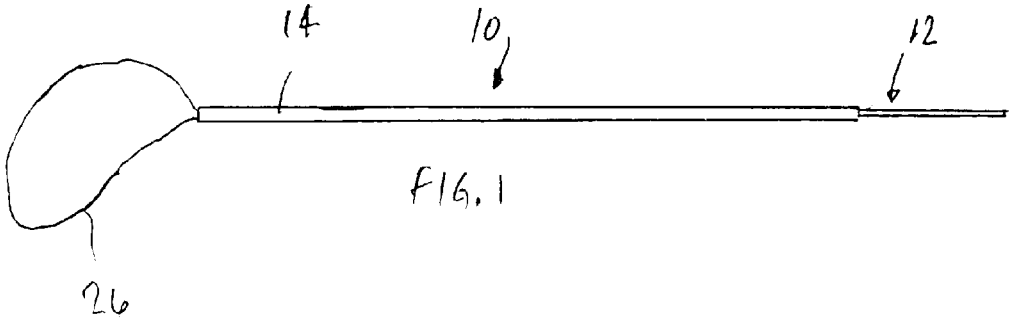
FIG. 1 is a plan view of a pull-truded fiber swab embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring to the figures and in particular FIG. 1, there is shown a swab 10 having a pull-truded fiber tip 12 embodying the principles of the present invention. The swab 10 includes, generally, a handle 14 and a cleaning head portion 16. The cleaning head 16 is formed from a fibrous material that, in a present embodiment, is inserted into an opening 18 in a tip securing end 20 of the handle 14 and sealed thereto.

Figure 2:
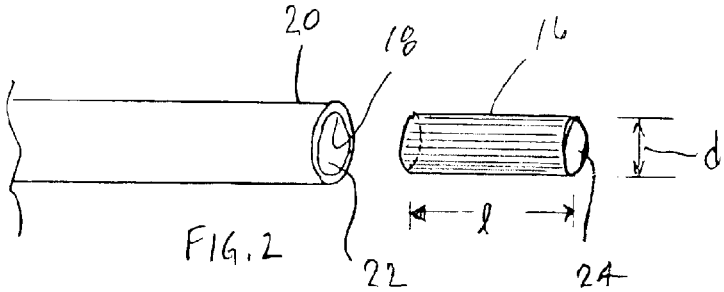
FIG. 2 is a partial, enlarged view of the cleaning end portion of the swab handle and a cleaning head or tip, showing the dimensional relationship between the handle and the cleaning head.
Figure 3:
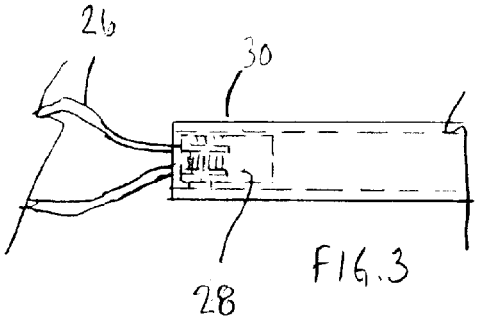
FIG. 3 is a partial, enlarged view of the grasping end portion of the handle and showing an optional tether affixed thereto by an internal plug.

In a current embodiment, the handle 14 is an elongated polypropylene tubular member having an open central region or bore 22. The cleaning head 16 is a pull-truded fibrous material. Pull-truding is similar to an extruding process except that rather than pushing the material through a die, the material is pulled through the die. In a present embodiment, a polyester material is pulled through a die to form the pull-truded fiber cleaning head 16. Pulling the fibrous polyester material compresses the fibers forming a relatively rigid composition. The tip or head 16 can then be cut to form, for example, a flat head 24 as illustrated in FIG. 2, an angled head (not shown), or other shapes as desired.

It is contemplated that the cleaning head 16 will be fabricated or pulled so that it can, dimensionally, snuggly fit within the bore 22 of the handle 14. Alternately, the cleaning head 16 can be mounted within the handle 14 and sealed thereto by, heat, ultrasonic welding, adhesive or the like.

The cleaning head 16 can be fabricated having a wide range of diameters d from about 1.0 millimeters (mm) to about 3.0 mm and lengths l, and a wide range of lengths from about 10 mm to about 30 mm. In a present embodiment, the cleaning head or tip 16 has a diameter d of about 1.25 mm and a length l of about 25 mm. Those skilled in the art will, however, appreciate the wide variety of tip 16 diameters and lengths.

Although the present swab 10 can be used for various cleaning applications, because of the rigidity of the cleaning head 16, and the ability to vary the cross-section shape and size of the head 16, it has been found that the present swab 10 is particularly well suited for use in cleaning fiber optic cable connectors and the like. It has also been found that the because the size and shape of the head 16 can be varied, the present swab 10 is also particularly well suited for use in cleaning fiber optic connectors, ferrules and like equipment.

The swab 10 can be fitted with an optional tether 26 formed from, for example, a flat woven low friction material. The tether 26 can be, for example, placed around a user's wrist so that the swab 10 cannot be inadvertently left or lost in a delicate or controlled area. Use of the tether-attached swab 10 is particularly well suited for example, when cleaning equipment in aerospace applications. The tether 26 can be affixed to the swab handle 14 by inserting a plug 28 or like element (that is affixed to the tether 26) into the handle bore 22 at a handle grasping end 30. Alternately, heat or adhesive can be used to secure the tether 26 to the handle 14. To this end, the tether 26 can be made permanently affixed to the handle 14 or removable from the handle 14.

Figure 4:
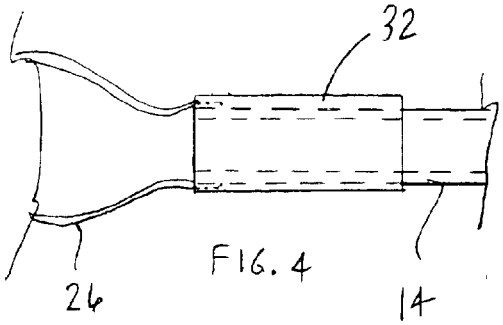
FIG. 4 is a partial, enlarged view of the grasping end portion of the handle and showing the optional tether affixed thereto by an external grip mount.

The tether 26 can also be attached or mounted to the handle 14 by a gripping portion 32 mounted over or externally of the handle 14, as shown in FIG. 4. In this arrangement, the tether 26 can be inserted between the gripping portion 32 and the handle 14, or directly attached to the grip 32. The grip portion 32 can be formed from rubber or a like readily gripped, non-slip material. The grip 32 also facilitates use of the swab 10 in a wide range of environmental conditions.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

What is claimed is:

1. A swab, comprising:

a handle defining a longitudinal axis, the handle being elongated and having a cleaning head end and a grasping end, the cleaning head end defining a securing region, the handle having a bore therein at the securing region; and a cleaning tip, the cleaning tip being formed from a plurality of extruded, compressed fibers formed by pulling the fibers through a die compressing the fibers into a substantially rigid, elongated cleaning head, the cleaning head being secured to the handle at the cleaning head end, the handle and cleaning tip defining a longitudinal axis, the cleaning tip being snugly fit within the handle bore.

2. The swab in accordance with claim 1 wherein the cleaning tip is formed from polyester fibers.

3. The swab in accordance with claim 1 wherein the cleaning tip is secured to the handle by ultrasonic welding.

4. The swab in accordance with claim 1 including a tether secured to the handle grasping end.

5. The swab in accordance with claim 4 wherein an end of the tether is inserted into the handle bore.

6. The swab in accordance with claim 4 wherein the tether is permanently mounted to the handle.

7. The swab in accordance with claim 4 wherein the tether is removably mounted to the handle.

8. The swab in accordance with claim 1 including a grip portion mounted externally of the handle.

9. The swab in accordance with claim 8 including a tether mounted to the swab at the grip portion.

10. The swab in accordance with claim 9 wherein a portion of the tether is disposed between the grip portion and the handle.

11. A swab comprising:

a handle defining a longitudinal axis, the handle being elongated and having a cleaning head end and a grasping end, the cleaning head end defining a securing region; and a cleaning tip, the cleaning tip being formed from a plurality of extruded, compressed fibers formed by pulling the fibers through a die compressing the fibers into a substantially rigid, elongated cleaning head, the cleansing head being secured to the handle at the cleaning head end, the handle and cleaning tip defining a longitudinal axis, wherein the handle is a hollow tubular member defining a central bore and the cleaning tip is formed having a shape and a dimension for inserting into the handle bore forming a non-bending swab.

* * * * *

US006795998C1

(12) EX PARTE REEXAMINATION CERTIFICATE (9996th)

United States Patent
Kammerer et al.

(10) Number: US 6,795,998 C1
(45) Certificate Issued: Jan. 2, 2014

(54) SWAB WITH PULL-TRUDED TIP

(75) Inventors: K. Scott Kammerer, Atlanta, GA (US); Edward J. Forrest, Jr., Marietta, GA (US)

(73) Assignee: Illinois Tool Works Inc., Glenview, IL (US)

Reexamination Request:
No. 90/012,485, Sep. 10, 2012

Reexamination Certificate for:

| | |
|---|---|
| Patent No.: | **6,795,998** |
| Issued: | **Sep. 28, 2004** |
| Appl. No.: | **09/621,722** |
| Filed: | **Jul. 24, 2000** |

(51) Int. Cl.
*A47L 25/00* (2006.01)
*A46B 3/00* (2006.01)

(52) U.S. Cl.
USPC ..... 15/209.1; 15/143.1; 15/159.1; 300/21

(58) Field of Classification Search
None
See application file for complete search history.

(56) References Cited

To view the complete listing of prior art documents cited during the proceeding for Reexamination Control Number 90/012,485, please refer to the USPTO's public Patent Application Information Retrieval (PAIR) system under the Display References tab.

*Primary Examiner* — Glenn K. Dawson

(57) ABSTRACT

A swab for cleaning electronic and electro-mechanical components includes a handle and a pull-traded fiber cleaning head. The handle is elongated and has a cleaning head end and a grasping end. The cleaning head end defines a securing region for securing the cleaning head to the handle. The cleaning head is formed from a plurality of fibers that are pulled through a die to compress the fibers into a substantially rigid, elongated cleaning head. The swab includes a tether to secure the swab and prevent inadvertent misplacement.

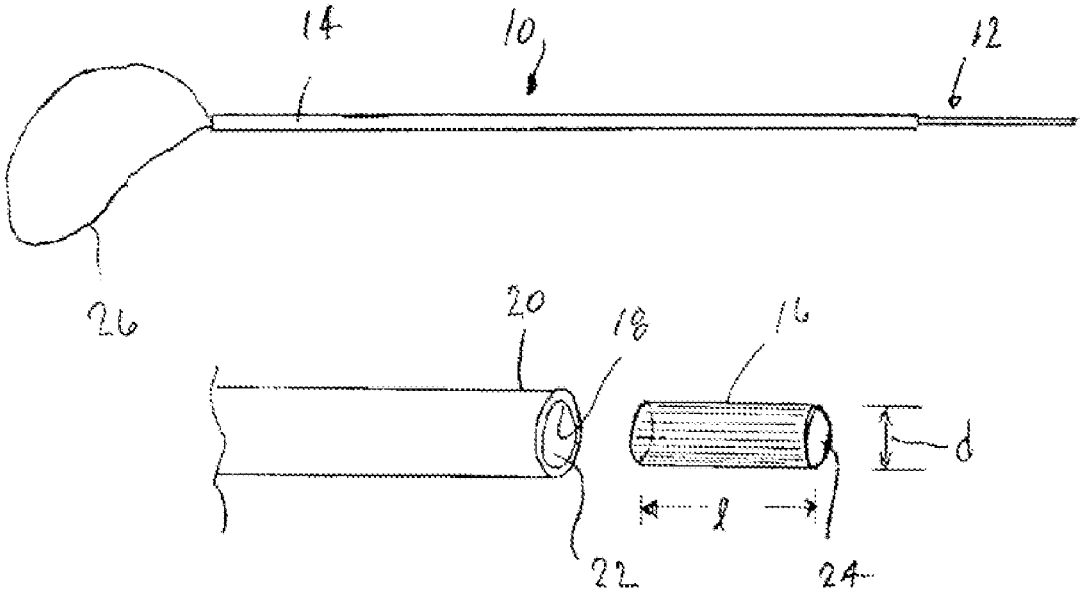

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1, 2 and 11 are cancelled.

Claims 3-10 were not reexamined.

* * * * *